US009713920B2

(12) United States Patent
Von Der Ahe

(10) Patent No.: US 9,713,920 B2
(45) Date of Patent: Jul. 25, 2017

(54) METHOD AND APPARATUS FOR DECORATING OBJECTS BY MEANS OF SCREEN PRINTING

(75) Inventor: Uwe Von Der Ahe, Preussisch-Oldendorf (DE)

(73) Assignee: Kammann Spezialmaschinen und Steuerungstechnik GmbH, Bünde (DE)

( * ) Notice: Subject to any disclaimer, the term of this patent is extended or adjusted under 35 U.S.C. 154(b) by 0 days.

(21) Appl. No.: 14/422,732

(22) PCT Filed: Aug. 31, 2012

(86) PCT No.: PCT/EP2012/066994

§ 371 (c)(1),
(2), (4) Date: Feb. 20, 2015

(87) PCT Pub. No.: WO2014/032729

PCT Pub. Date: Mar. 6, 2014

(65) Prior Publication Data

US 2015/0217562 A1 Aug. 6, 2015

(51) Int. Cl.

| | |
|---|---|
| ***B41F 15/08*** | (2006.01) |
| ***B41F 15/44*** | (2006.01) |
| ***B41M 1/12*** | (2006.01) |

(52) U.S. Cl.

CPC ..... *B41F 15/44* (2013.01); *B41F 15/0872* (2013.01); *B41M 1/12* (2013.01); *B41F 15/08* (2013.01)

(58) Field of Classification Search

None

See application file for complete search history.

(56) References Cited

U.S. PATENT DOCUMENTS 3,286,624 A * 11/1966 Dubuit ..... 101/40
3,543,680 A * 12/1970 Jones ..... B41F 15/0872 101/123

(Continued)

FOREIGN PATENT DOCUMENTS

EP 0 834 399 A1 4/1998

OTHER PUBLICATIONS

Int'l Preliminary Report on Patentability issued Mar. 12, 2015 in Int'l Application No. PCT/EP2012/066994.

(Continued)

*Primary Examiner* — Jill Culler

(74) *Attorney, Agent, or Firm* — Panitch Schwarze Belisario & Nadel LLP

(57) ABSTRACT

A screen printing method and an apparatus are provided for printing on objects (12) which can be rolled against a printing screen (34). The method and apparatus provide the possibility of printing on the region (13) of the object to be printed upon over the entire periphery thereof, that is over 360°, even when the length of the final overall print image in the peripheral direction of the object is longer than the spacings between the individual objects passing through the printing station. For that purpose, the peripheral surface to which the final overall print image is to be applied is subdivided into at least two portions (13*a, b*) which are displaced relative to each other in the peripheral direction of the object (12). Each of those portions is provided with at least one individual print (53), wherein a plurality of individual prints applied to the same portion (13*a, b*) can supplement each other to afford a colored partial print image.

17 Claims, 3 Drawing Sheets

(56) References Cited

U.S. PATENT DOCUMENTS

| | | | | | |
|---|---|---|---|---|---|
| 3,810,422 | A | * | 5/1974 | Kammann | 101/40 |
| 3,905,292 | A | | 9/1975 | Rossi | |
| 4,048,914 | A | * | 9/1977 | Kammann et al. | 101/35 |
| 4,848,227 | A | * | 7/1989 | Campioli | 101/39 |
| 5,343,804 | A | * | 9/1994 | Karlyn et al. | 101/39 |
| 5,471,924 | A | * | 12/1995 | Helling | B41F 15/0872 101/124 |
| 5,711,216 | A | * | 1/1998 | Tiemann et al. | 101/40.1 |
| 6,070,524 | A | | 6/2000 | Marroquin-Garza et al. | |
| 6,164,199 | A | * | 12/2000 | Dubuit et al. | 101/38.1 |

OTHER PUBLICATIONS

Int'l Search Report and Written Opinion issued on May 27, 2013 in Int'l Application No. PCT/EP2012/066994.

* cited by examiner

METHOD AND APPARATUS FOR DECORATING OBJECTS BY MEANS OF SCREEN PRINTING

CROSS-REFERENCE TO RELATED APPLICATIONS

This application is a Section 371 of International Application No. PCT/EP2012/066994, filed Aug. 31, 2012, which was published in the German language on Mar. 6, 2014, under International Publication No. WO 2014/032729 A1, the disclosure of which is incorporated herein by reference.

BACKGROUND OF THE INVENTION

The invention concerns a method and an apparatus for decorating objects with a print image produced by screen printing.

The length of the print image in the peripheral direction of the object also determines the length of the stencil representing that print image in the printing screen. The object is rolled against that printing screen during the printing procedure. That gives rise to a certain minimum length for the printing screen. It will be appreciated, however, that this is greater than the length of the print image because, at each end thereof, the printing screen has an additional portion which is generally impermeable to printing ink. The additional portion which is at the front in the transport direction of the objects receives the ink which is intended for the respective printing operation and which is distributed over the print image in the printing screen during the printing operation by the squeegee. The squeegee is applied to the printing screen in that portion, and the ink is brought into contact with the object through the open meshes representing the print image. The additional portion of the printing screen, which is downstream of the print image in the transport direction, serves to receive the excess ink which is displaced by the squeegee into that portion. The lifting movement of the squeegee from the screen, which occurs after the conclusion of the printing operation, can also be performed in that portion. The ink which has not been used at the end of the printing operation can be removed in the usual way from that portion, for example by a discharge conduit, through which the excess ink flows from the printing screen into a storage container from which it can be returned to the printing screen. The man skilled in the art is familiar with the means and measures required for that purpose.

Known screen printing machines are so designed that all-round printing can be effected in a printing operation. The expression "all-round printing" means here that, in the printing operation, in the printing station, the object is rotated through 360° about its longitudinal axis. In that case, there is the possibility of the object being provided with printing over its entire periphery in one printing operation. In this case then, the stencil in the printing screen is also of a length corresponding to the length of the total periphery. The resulting print image, however, can also extend only over a part of the total periphery, insofar as it is shorter and/or has interruptions. For example, in such a way, the object is provided with at least two print image portions at a spacing from each other in the peripheral direction. The configuration of the final print image is dependent on the respective factors involved and can be implemented, for example, for decorative reasons or also for reasons relating to printing technology. Such reasons apply for example when, as is usual in particular in relation to drinks bottles, the objects have irregularities, caused by the manufacturing process, on the surface to be decorated. Those irregularities can be caused, for example, by the mold in which the bottles are produced.

That known possible way of all-round printing on the object presupposes that there is a minimum spacing between the objects which are to be successively introduced into the printing station. The minimum spacing takes account of the length of the overall printing screen, including the holder carrying it, for example in the form of a frame, because the respective following object can be brought into contact with the stencil, at the beginning of the actual printing operation, only when the printing operation on the respectively preceding object is concluded.

It is usual for the decoration of objects, for example bottles, to be effected in directly connected relationship with bottle production. For that purpose, the apparatuses required for the individual production and treatment operations are connected in direct succession and are connected together to afford a production line by one or more transport means for the objects. Thus, the speed at which the objects are fed to the screen printing station is predetermined by the speed at which the objects leave the manufacturing apparatus, that is by the number of bottles produced per unit of time. In the apparatuses which are usual nowadays, particularly for producing glass bottles, that number is so high, for example 250 bottles/minute of a diameter of preferably 62-75 mm, that the spacings between two successive objects are so short that printing would not be possible with a screen printing stencil which is of dimensions for all-round printing, because the length of the printing screen or the stencil in the transport direction would be too great for the spacing between two successive objects.

BRIEF SUMMARY OF THE INVENTION

The invention starts from the presumption that the transport path available for each object for the application of the print image is predetermined by the spacing between the individual objects. It is further presumed, always in dependence on the respective conditions involved, in particular the length of the print image and the diameter of the object, that the length of the transport path available for each object in the printing station is not sufficient to apply to the object a print image requiring the total periphery in one printing operation or printing station. That applies, in particular but not exclusively, to objects which are circular in cross-section and which are intended to receive all-round printing over their entire periphery.

The object of the invention is to modify known screen printing methods and apparatuses in which printing on the object is effected during transport thereof. This is done in such a way that all-round printing thereof is made possible without the transport flow of the objects through the at least one screen printing station and possibly additional treatment stations being adversely affected, and in spite of the transport speed, which is predetermined by the output of the object production apparatus and the small spacings governed thereby between the objects passing through the printing station.

That object is attained by the teachings herein, which can be summarized along the lines that the print image to be applied to the object is subdivided in the peripheral direction of the object into at least two partial print images which are applied to the object in at least two successive printing operations. That takes account of the fact that the length of the stencils in the printing screen and thus the length of the print image to be applied to the object is dependent on the spacing between two successive objects carried by the transport means. The respective partial print images can each represent only one portion of an overall print image, which represents a finished decorative design or, for example, a complete piece of information in the form of an inscription, or a combination of both, only after the application of the second partial print image. It is, however, also possible that each partial print image represents a complete design or a complete inscription in the sense, for example, of a piece of information and represents same without reference to the other partial print image. When using known screen printing apparatuses and methods, the partial print images are at any event applied in only one printing operation.

During the printing operation the objects can assume a position in which their longitudinal axis extends substantially vertically. That has the advantage that, because the objects, in particular drinks bottles of glass, generally leave the location at which they are produced in a standing condition, no further handling of the bottles for the purposes of changing their position is required. The objects, however, can also be printed upon in a lying down condition, that is with their longitudinal axis extending horizontally, or also in any other position permitting the printing operation to be performed.

A screen printing machine in which the objects are fed and printed upon in a standing position is disclosed in U.S. Pat. No. 3,905,292.

Methods and apparatuses according to the invention are suitable particularly for printing on glass bottles, which in particular as drink bottles are preferably used in a diameter, for example, of 62 mm-75 mm and which, due to the production procedure involved, have two markings which are generally displaced relative to each other through 180° and which in the majority of cases are linear and which are similar to a seam, the markings also forming the above-mentioned irregularities on the surface to be printed upon. In an operation for all-round printing without interruption, those irregularities cause a considerable stress loading on the stencil, although the printing screen and also the free end of the squeegee, which sits on the printing stencil during the printing operation, have a certain degree of elasticity which is intended to compensate for irregularities in regard to the shape of the object and/or the nature of the surface thereof. Nonetheless, those inevitable irregularities cause stressing in particular of the printing stencil, which also increases with increasing printing speed, that is with an increasing speed of transport movement of the object during the printing operation.

It is obvious that, with the premises from which the invention starts, namely such a high output from the apparatus producing the objects that the spacing between the objects is too small for all-round printing, the speed at which the objects are also transported through the treatment stations is correspondingly greater than in the case of methods and apparatuses in accordance with the state of the art. That necessarily also leads to a higher peripheral processing speed at which the objects are rolled against the printing screen. When there are irregularities on the surface of the object to be printed upon, that entails a correspondingly greater stress on the stencil. It is here that the invention affords the advantage, by virtue of the print image being subdivided to two printing operations, that in each operation only the respective peripheral region of the object between the two markings is printed upon, and thus each print image portion can be slightly shorter in the peripheral direction than corresponds to the spacing between the two markings produced by manufacture.

Theoretically, even when using the methods and apparatuses according to the invention in which all-round printing is effected in one working operation, it would be possible to avoid stressing the printing screen by the markings on the surface of the object that is to be printed upon, by the squeegee being lifted off the printing screen shortly before the respective marking is reached and then being put back on to the printing screen after the marking is passed. That, however, would lead to disturbances in the system formed by the printing screen, ink disposed thereon and the moving squeegee, which would result in an adverse influence on the quality of the print image. The invention affords a possible way of avoiding those problems, if the respective partial print image is applied only in the region between the irregularities caused by manufacture, and thus it is possible to avoid any contact between the printing screen and the regions having the irregularities.

It will be appreciated, however, that the invention can also be used in those situations in which at least one of the partial print images also extends over such a marking or irregularity.

The partial print images, and thus possibly also the final overall print images formed thereby, can be in one color or in two or more colors. It is also possible for the two partial print images applied to an object to be provided with different color inks or combinations thereof. The partial print images of an object, as already mentioned, can give the impression of a visual overall print image or an overall print image which is coherent in terms of its content. It is, however, also possible for the partial print images to be of such a design configuration that they are perceived as being separate, without involving any interrelationship which is visual or in terms of significance thereof. That can be the case, for example, when a partial print image represents mere decoration and another partial print image on the same object represents an inscription, coding or the like.

The invention can also be used when the object is of an approximately elliptical cross-section in the region to be printed upon, in which case then both surface regions of the object, to which the printing is to be applied, can be rolled against the screen printing stencil. In this case also, as in the case of cylindrical objects, the peripheral surface to which the final overall print image is to be applied is subdivided into at least two portions which are displaced relative to each other in the peripheral direction of the object, wherein each of those portions is provided with at least one individual print and a plurality of individual prints applied to the same portion can supplement each other to afford a colored partial print image comprising different colors.

The sequence in which the individual prints are applied to the portions of the object can be freely selectable, more specifically irrespective of whether the partial print images and the final overall print image involve one color or two or more colors, wherein, because of the separate application of the partial print images and the individual prints forming them, on the same object, different color combinations for the partial print images are possible in such a way that one partial print image contains at least one color which the other partial print image does not.

Thus, the number of required printing stations is dependent on the number of individual prints per object and the number of printing ink colors making up the final overall print image.

Advantageously, inks are used which harden under the effect of UV rays. Therefore, the use of such UV inks also involves drying stations with at least one UV lamp, wherein advantageously such a drying station is arranged downstream of each printing station in the object transport direction. The drying station is desirably provided with a scattering reflector, so that the at least one UV lamp produces a beam field or array which involves a radiation intensity that is as uniform as possible along the UV drying section in the drying station, wherein the drying section is part of the object transport path. Desirably, the length of the print image, the spacing of the objects, the diameter of the objects, the spacing of the drying station from the printing station, and further parameters relevant here are so matched to each other that the object printed upon in a printing station is transported in the correct position into the region of the UV rays in such a way that, when the drying section formed by the beam array is reached, the respective individual print passes into the beam array and in the course of further transport of the object, which is rotated about its longitudinal axis, the entire individual print passes through the region of action of the beam array.

The overall print image, which is composed of at least two partial print images, can also be of one color, so that at least two printing stations would be required to produce such an overall print image.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. An embodiment of the invention is illustrated in the drawing in which.

DETAILED DESCRIPTION OF THE INVENTION

Figure 1:
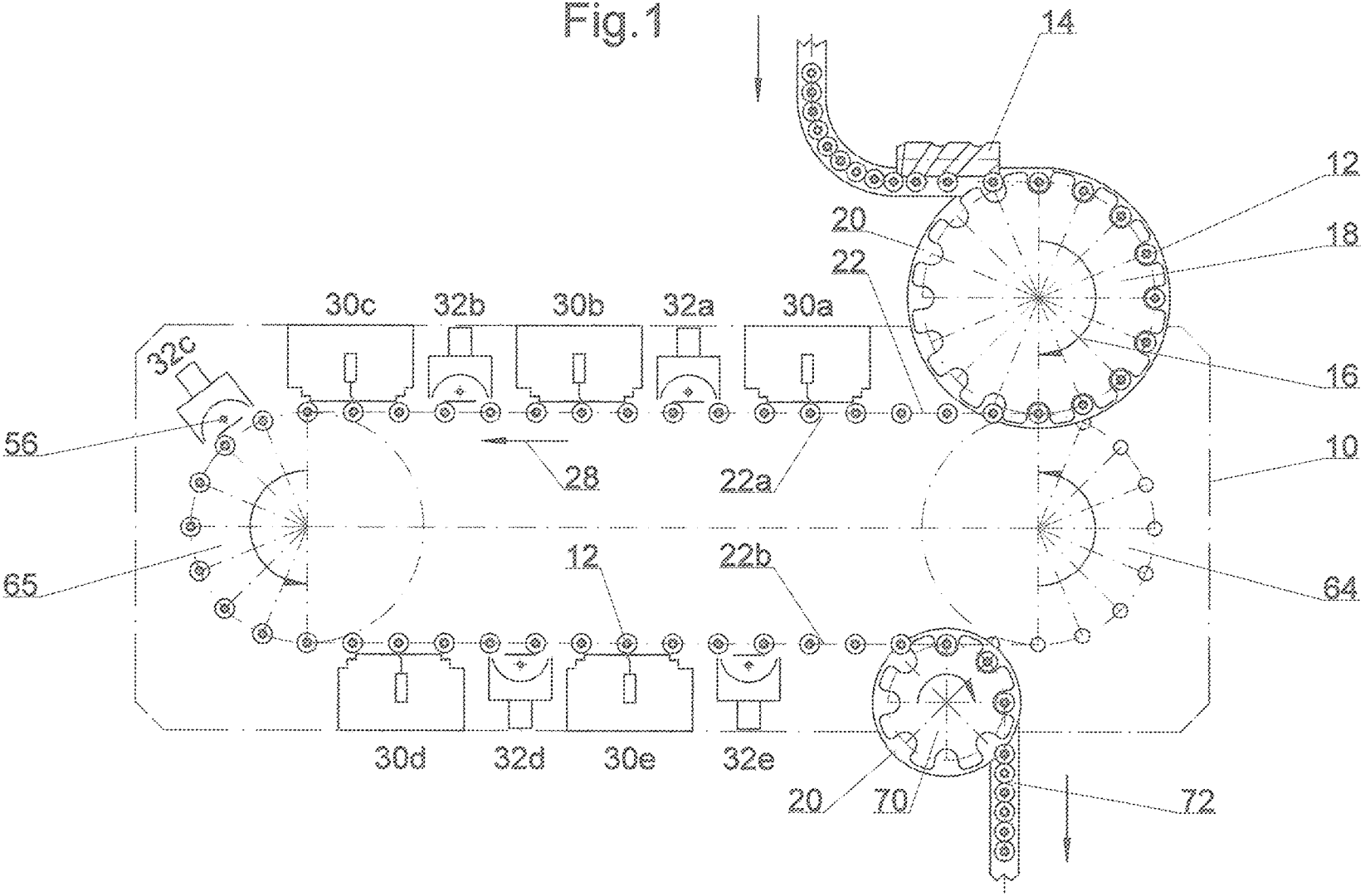
FIG. 1 is a highly diagrammatic plan view of a printing machine according to an embodiment of the invention having a plurality of treatment stations arranged in succession in the transport direction of the objects.
Figure 3:
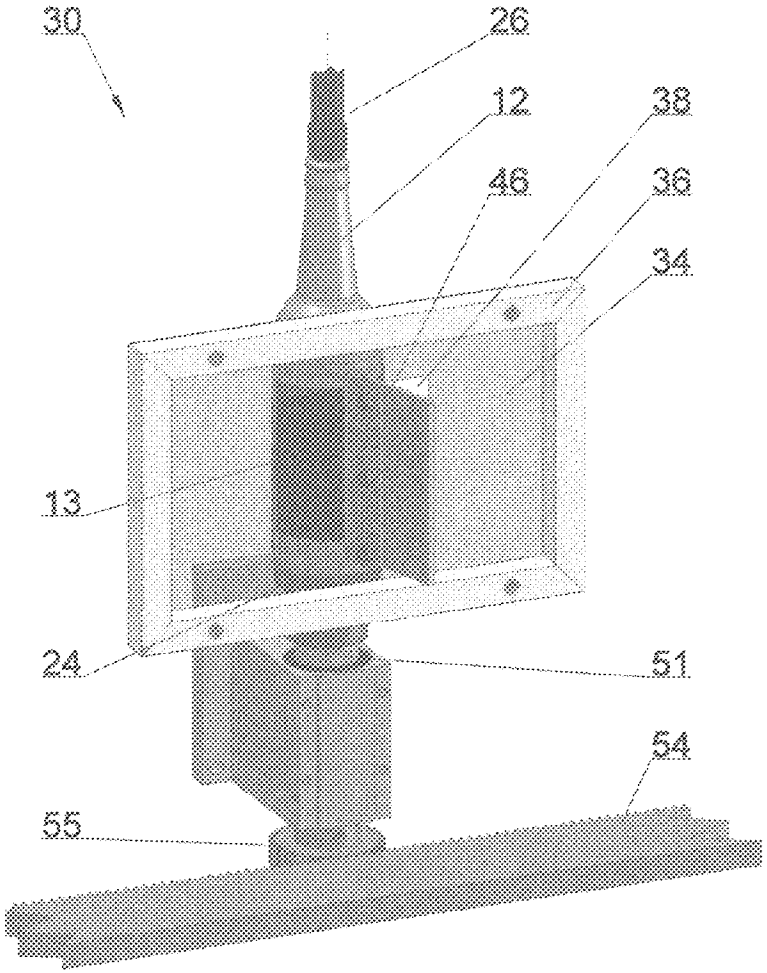
FIG. 3 is a perspective view of a bottle disposed in the printing station of the printing machine and supported by a holder.

The printing machine 10 shown in FIG. 1 is arranged as part of a production line downstream of an apparatus (not shown in the drawing) for the manufacture of glass bottles 12 (see FIG. 3). The bottles which come from the production apparatus and of which the region 13 to be printed upon is substantially cylindrical are fed by way of a transport screw 14 in a standing condition to a transport wheel 18 rotating continuously in the direction of the arrow 16. The transport wheel 18 is provided at its periphery with recesses 20, which each receive a respective bottle to feed the bottles at fixed spacings to a third circulating transport element 22 which, for example, can be in the form of a chain or otherwise of suitable configuration. That chain is provided with holders for the objects to be printed upon, that is the bottles 12. The holders generally comprise two components, namely a first holder portion 24 (see FIG. 3) which receives the bottom end portion of the bottle and which is matched to the bottom-end diameter of the bottle and is provided with a suitable receiving means, and a second holder portion 26. The latter usually has a conical extension which engages into the neck opening of the bottle so that the bottle is fixed between the two holder portions rotatably about its longitudinal axis.

The two holder portions 24, 26 are arranged displaceably relative to each other in the usual way in the longitudinal direction of the bottle. When the respective bottle to be taken over from the transport wheel 18 is reached, the two holder portions are moved apart so that, in the course of the transfer from the transport wheel 18 to the third transport element 22, the bottle is moved between the two holder portions, whereupon, as soon as the bottle and the two holder portions are axially aligned with each other, the holder portions are moved relative to each other, with a reduction in their mutual spacing, so that they grip and support the bottle, as shown in FIG. 3.

The spacings between the recesses 20, which are provided on the transport wheel 18 and which receive the bottles, correspond to the spacings 44 (FIG. 2) between the holders 24, 26 carried by the chain 22 or the like. Those spacings are determined by the output of the apparatus manufacturing the bottles, that is by the number of bottles produced per unit of time.

The treatment stations, which involve in particular printing stations 30 and drying stations 32, are arranged along the third transport element 22 in the transport direction 28.

Besides the printing and drying stations it is also possible to provide further stations, for example a station upstream of the first printing station 30*a* in the transport direction 28, being a station in which the bottles are aligned in the peripheral direction, that is brought into register relationship, in such a way that the print image is applied in a given region of the periphery on the bottle. Additional treatment and handling operations of that kind and the associated stations are known, so that they are not discussed in detail here.

Figure 2:
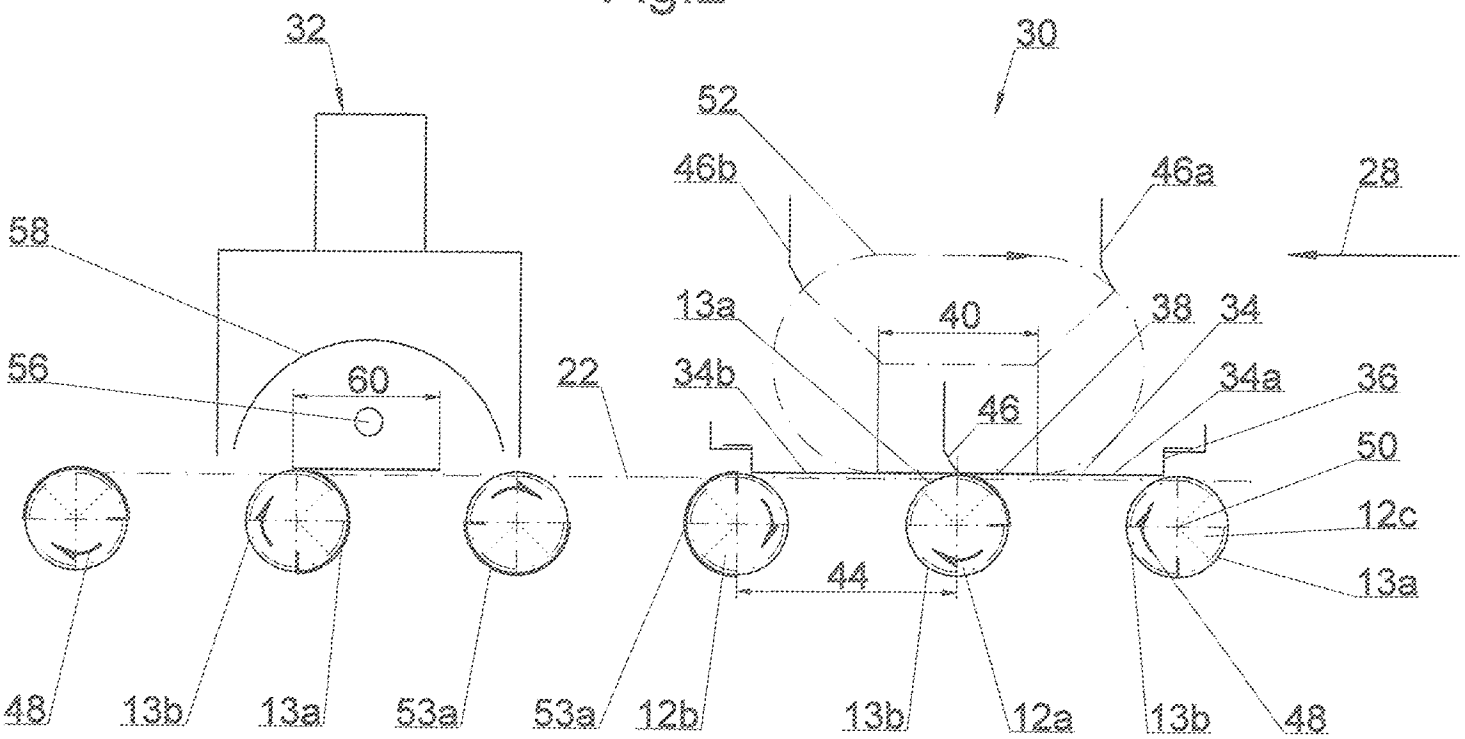
FIG. 2 is a simplified plan view of a screen printing station and a drying station arranged downstream thereof in the object transport direction of the printing machine of FIG. 1.

FIG. 2 of the drawing shows one of the printing stations 30 arranged along the third transport element 22 and a drying station 32 arranged downstream thereof in the transport direction 28. The printing screen 34, which is arranged in the printing station 30 and which is carried by a frame 36, has a stencil 38 corresponding to the print to be applied. The length 40 of that stencil in the transport direction 28 is of such a dimension that it approximately corresponds to half the periphery, preferably somewhat less, of the bottle 12 in the region 13 thereof. If the length 40 of the stencil corresponds to half the periphery of the bottle 12, then the latter performs a rotational movement through 180° about its longitudinal axis while passing through the travel path determined by the length 40.

FIG. 2 shows that the printing screen 34 including the frame 36 is approximately of the maximum length for the spacings 44 between the individual objects, because, with a bottle 12*a* disposed on half the travel path 40 between the beginning and the end of the printing stencil 38, the object 12*b* printed upon in the preceding printing operation is just leaving the region of the printing screen. That is, it is at the end of the printing screen that is downstream in the transport direction 28, while the object 12*c* to be printed upon in the following printing operation has just reached the end of the printing screen 34, that is the leading end in the transport direction 28. That means that the print image in the transport direction 28 or in the peripheral direction of the object 12 may not be larger than approximately half the periphery of the object, as otherwise the preceding object 12*b* would still be in the region of the printing stencil 38 of the printing screen 34, and the following object 12*c* would already be in that region.

The actual printing screen 34 has three portions disposed in succession in the transport direction 28, namely a first portion 34*a* upstream of the stencil 38 in the transport direction 28, the stencil 38 and a second portion 34*b* downstream of the stencil 38 in the transport direction 28. The two portion 34*a*, 34*b* do not serve directly for transfer of the printing ink from the printing screen 34 on to the object. Rather, it is in the portion 34*a* that the ink intended for the respectively following printing operation is applied. The ink which is put on to the printing screen in the portion 34*a* is then distributed by the squeegee 46, which is respectively associated with that printing operation, over the printing screen and the stencil therein. The ink is moved in the direction towards the end of the printing screen that is the rear end in the transport direction 28, in such a way that, in the region of the stencil, the printing ink is transferred through the open meshes of the screen on to the surface of the object, that is to be printed upon. After the conclusion of that ink transfer, that is after the squeegee 46 is downstream of the stencil 38 in the transport direction 28, the squeegee is lifted off the printing screen in the second portion 34*b* thereof. The excess of printing ink that possibly remains in the portion 34*b* after each printing operation can then be removed from the printing screen in the usual way and, for example, fed to a storage container.

By virtue of the elasticity of the printing screen 34 it is pressed against the respective article by the squeegee 46 after it has been placed thereon in the portion 34*a* and is held in contact with the object during the synchronous movement of the squeegee 46 and the object 12 along the stencil 38, that is at least over the travel path 40 thereof. After the squeegee has been lifted off the printing screen 34 in the portion 34*b* thereof the printed article is no longer in contact with the printing screen 34 so that the printed article can be moved without any problems out of the region of the printing station in a direction towards the drying station 32 downstream thereof.

A corresponding procedure applies for introduction of the respectively following object 12*c* into the printing station. FIG. 2 shows that the article 12*c*, which rotates about its longitudinal axis 50 in the direction of the arrow 48, is initially not in contact with the printing screen, as the squeegee 46*a* which is associated with that article and which causes the contact to occur between the article and the printing screen is applied to the stencil 38 only shortly before the end thereof, that is the leading end in the transport direction 28, and thereby forms the contact between the article and the printing screen. At that point in time the article 12*a*, which is shown in FIG. 2 approximately at the center of the stencil, is already in the region of the second portion 34*b*, in which case the associated squeegee 46*b* is already lifted off the printing screen and there is thus no longer any contact between same and the article.

The squeegees are parts of a system having a plurality of squeegees, in the specific case here three squeegees, which circulate along an approximately elliptical path 52, as can also be seen from FIG. 2. Such a squeegee system is known, so that no further discussion thereof is required.

When using printing ink which hardens under the effect of UV rays, a drying station 32 is arranged downstream of the printing station, wherein the objects provided with at least one individual print 53 are advanced into the drying station 32 by the third transport element 22 in order to dry the respective last applied individual print.

The above-mentioned rotational movement of the individual bottles 12 is produced by a rack 54 (see FIGS. 3 and 4), which extends along the third endless transport element 22 and the guide wheels 64, 65 thereof. Each holder for the bottles is provided at its first holder portion 24 with a gear 55 in engagement with the rack 54 in such a way that, when the bottles are transported through the treatment stations, the above-mentioned rotational movement in the direction of the arrow 48 is transmitted to the gear and at least the first holder portion 24 connected thereto by way of a shaft 51. It is apparent that the peripheral speed of the bottle, caused by that rotational movement, in the bottle region to be printed upon, is so selected that, having regard to all parameters, for example bottle diameter, transport speed, a possible difference in the diameter of the gear 55 and the bottle region to be printed upon, the bottle is rolled against the printing screen or its stencil as much as possible without slip.

The printing station 30 and the respectively associated drying station 32 are arranged along the transport path for the bottles relative to each other in such a way that, on the one hand, the distance between the printing station and the drying station is as short as possible while, on the other hand, the bottles are optimally oriented in the peripheral direction on passing through the drying station. The drying station 32 is provided with a UV radiating device 56 and a reflector 58. The latter is in the form of a scattering reflector, so that a homogeneous beam array with a substantially uniform beam intensity is present over the length in the transport direction of the UV drying section 60. The length of the drying section 60 approximately corresponds to the length of the individual print 53 or the partial print image, but at any event should not be shorter than same.

In the illustrated embodiment the spacing between the printing station 30 and the drying station 32 is so selected that, after leaving the region of the printing screen 34, that includes the stencil 38, the bottle still performs one and a half revolutions about the longitudinal axis before it then passes into the UV drying section 60, in such a way that, in the course of the following rotation, the entire last-applied individual print of the partial printing image is exposed to the beam array. In that case, the partial print image is generally somewhat shorter than 180° in the peripheral direction, so that the individual printing of the partial print image can be applied in the region between the two markings 62 (see FIG. 4) caused by manufacture of the bottle, on the region 13 to be printed upon, without extending on to those markings, which are parallel to the longitudinal axis of the bottle.

Figure 4:
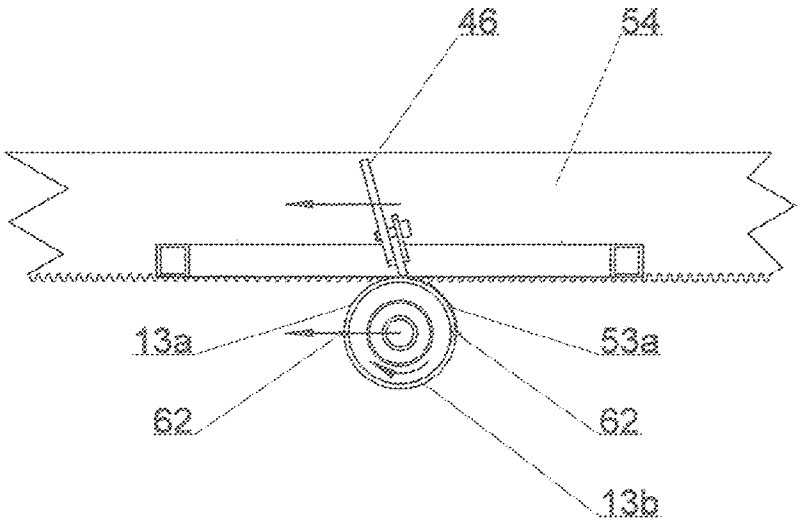
FIG. 4 is a diagrammatic simplified associated plan view of the bottle and printing station of FIG. 3.

The printing machine shown in FIG. 1 of the drawing is provided with five printing stations 30*a-e* and five drying stations 32*a-e*, wherein a drying station is arranged downstream of each printing station in the transport direction 28. In the first printing station 30*a* the region 13 of the bottle, to which the printing is to be applied, as also shown in FIGS. 2 and 4, is provided on the first peripheral portion 13*a*, which extends between the two markings 62 that are displaced relative to each other through 180° in the peripheral direction, with a first individual print 53*a* of a partial print image. The partial print image comprises three individual prints, and approximately the first half is applied in the position of the parts shown in FIG. 4 relative to each other. In the course of the further transport movement and the rotation linked thereto about the longitudinal axis of the bottle, that individual print is completed on a peripheral length of about 180°, as is the case with the bottle 12*b*—and the bottles preceding it—in FIG. 2. The bottle printed upon in that way is then passed through the first drying station 32*a*, which is arranged downstream of the printing station 30*a* and in which the individual print 53*a* which has just been applied is dried.

In the course of the further continuous transport movement in the direction of the arrow 28, the bottle passes into the second printing station 30*b* in which a second individual print is applied in another color in the region of the first individual print 53*a*, which had been applied in the station 30*a*. The second individual print in the other color is dried in the second drying station 32*b*. Those processes are repeated to apply a third individual print of a third color in the region of the individual prints already applied in the first two printing stations, in the third printing station 30*c*, followed by drying in the third drying station 32*c*. That means that the partial print image, which is to be applied in the portion 13*a* and which occupies almost one half of the bottle periphery, is finished.

The third drying station 32*c* is disposed in the region of the second guide and/or drive wheel 65, around which the endless chain 22 is guided to form a second transport run 22*b* extending parallel to the first transport run 22*a*. Arranged at the latter are the three printing stations 30*a-c* and the two drying stations 32*a, b*. That way of guiding the transport chain 22 permits the printing station to be of a compact structure in spite of the presence of a larger number of treatment stations.

In the fourth printing station 30*d*, associated with the second transport run 22*b*, a first individual print of a second partial print image can then be applied to the second portion 13*b* of the region 13 to be printed upon, that is in opposite relationship to the first peripheral portion 13*a*, and then dried in the following drying station 32*d*. Then, in the last printing station 30*e*, an individual print which, for example, is of a different color can then be applied in the region of the individual print produced in the printing station 30*d*. As a result thereof, there is a final overall print image comprising two three-colored or two-colored partial print images, which in turn are composed of a plurality of one-colored individual print images.

In the above-described embodiment it is assumed that the partial print image, which can comprise a plurality of individual prints, extends continuously over the peripheral portion 13*a*. As a departure therefrom, however, it is also possible for at least one of the partial print images to be discontinuous in the sense that it comprises at least two portions which are arranged in succession in the peripheral direction of the bottle and/or in the direction of the longitudinal axis of the object.

In regard to the printing machine, other combinations and associations from those described hereinbefore are also possible. Thus, there can be more or fewer printing stations and drying stations, always depending on the respective requirements involved, that is the nature of the respective final overall print image.

The spacings between the individual treatment stations should be as small as possible in order also to keep the size of the printing machine as small as possible, although the dimensions thereof naturally depend on the number of printing and drying stations and the other treatment stations. In general, it will be desirable for the spacings between the individual stations to be so selected that they represent an optimum between achieving a minimum possible spacing between two successive stations and the length of the transport path required to ensure the respectively required positioning of the object in the peripheral direction for treatment in the next station, with a given object diameter. That includes, for example, the requirement that the individual prints of a respective partial print image should be respectively correctly oriented relative to each other.

After leaving the last treatment station the bottles 12 provided with the final overall print image are transferred from the third transport element 22 to a second transport wheel 70 which, like the first transport wheel 18, is also provided with edge recesses 20 for receiving the bottles, wherein in the transfer station the two holder portions 24, 26 of the holder carrying the bottle during transport thereof through the third transport element 22 are moved apart to release the respective object. The second transport wheel 70 then passes the bottles to a next following transport means 72 which feeds the bottles to a further treatment or use.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A screen printing method for printing on an object (12) after production of the object by a production machine, the method comprising:

providing the object produced by the production machine directly to a printing machine (10), the object having a region (13) configured to receive a print image, the print image being comprised of at least two partial print images, the region (13) being comprised of at least two portions (13*a*, 13*b*) displaced relative to each other in a peripheral direction of the object;

transporting the object (12) by a transport element (22) continuously through at least two printing stations (30) of the printing machine (10), each printing station (30) comprising:

a printing screen (34) having a stencil (38) corresponding to at least one individual print (53) to be produced, at least one squeegee (46) which is moveable in a transport direction (28) along the stencil during a printing operation synchronously with the respective object to be decorated in the at least two printing stations (30), and holders (24, 26) which respectively carry the objects rotatably about their longitudinal axes (50), the holders being mounted to the transport element (22) and being arranged at a spacing (44) from each other in the transport direction (28), the spacing being smaller than a spacing that would be required for peripheral printing around 360° on the object in one working operation; and printing one of the at least two partial print images upon a respective one of each of the at least two portions (13*a*, 13*b*) separately during a transport by rolling the objects against the printing screen (34), the speed of the transport element (22) being predetermined by an output of the production machine.

2. The method as set forth in claim 1, wherein more than one individual print (53) is applied to at least one of the at least two portions (13*a*, 13*b*) and all individual prints on the at least one portion supplement each other to provide one of the at least two partial print images.

3. The method as set forth in claim 2, wherein the individual prints (53) on the at least one portion (13*a*, 13*b*) supplement each other to afford the print image.

4. The method as set forth in claim 1, wherein the object (12) while rolling against the printing screen (34) over a length (40) of a stencil (38) rotates not more than 180° about a longitudinal axis (50) of the object.

5. The method as set forth in claim 1, wherein the at least one individual print (53) is applied between two markings (62) extending on the object parallel to a longitudinal axis of the object, the markings being displaced relative to each other in the peripheral direction due to manufacture of the object.

6. The method as set forth in claim 1, further comprising subjecting the object (12) to a homogeneous UV beam array by a UV drying station (32) after printing the individual print (53).

7. An apparatus for decorating objects (12) by screen printing, the apparatus being configured to be arranged in a production line downstream of a machine for producing the objects (12), the apparatus comprising:

at least two printing stations (30), each printing station (30) comprising:

a printing screen (34) having a stencil (38) corresponding to a print to be produced, at least one squeegee (46) which is moveable in a transport direction (28) along the stencil during a printing operation synchronously with the respective object to be decorated in the at least two printing stations, and holders (24, 26) which respectively carry the objects rotatably about their longitudinal axes (50), the holders being mounted to a transport element (22) which transports the objects (12) continuously through the at least two printing stations (30) in which printing is effected during a transport by rolling the objects against the printing screen (34), the speed of the transport element (22) being predetermined by an output of the machine for producing the objects (12), wherein the holders (24, 26) for carrying the objects (12) are arranged at a spacing (44) from each other in the transport direction (28), the spacing being smaller than a spacing that would be required for peripheral printing around 360° on the object in one working operation, wherein the objects (12) have a region configured to receive a print image, the print image being comprised of at least two partial print images, the region being comprised of at least two portions (13*a*, 13*b*) displaced relative to each other in a peripheral direction of the objects, and wherein at least one of the at least two printing stations (30) is associated with each of the portions (13*a*, 13*b*) to apply one of the at least two partial print images to the associated portion.

8. The apparatus as set forth in claim 7, wherein more than two of the printing stations (30) are associated with at least one of the at least two portions (13*a*, 13*b*).

9. The apparatus as set forth in claim 7, wherein a length of an individual print (53) applied in one of the at least two printing stations (30) in the peripheral direction of the object is not more than 180°.

10. The apparatus as set forth in claim 9, wherein the individual print (53) is applied between two markings (62) extending on the object (12) parallel to a longitudinal axis (50) of the object, the markings being displaced relative to each other through about 180°.

11. The apparatus as set forth in claim 8, wherein at least two individual prints (53) applied to at least one of the portions (13*a*, 13*b*) supplement each other to afford a partial print image.

12. The apparatus as set forth in claim 11, wherein at least two of the partial print images supplement each other to afford an overall print image.

13. The apparatus as set forth in claim 7, further comprising a drying station (32) arranged downstream of each of the at least two printing stations (30) and having a UV lamp (56) producing a radiation field.

14. The apparatus as set forth in claim 13, wherein the UV lamp (56) produces a radiation field having a radiation intensity which is substantially uniform in the transport direction (28) of the object (12) to be printed upon.

15. The apparatus as set forth in claim 14, wherein a length of the radiation field in the transport direction (28) corresponds to a length of a partial print image in the peripheral direction of the object (12).

16. The apparatus as set forth in claim 13, wherein a common transport system is associated with the at least one printing station (30) and the drying station (32) associated therewith.

17. An apparatus for decorating objects (12) by screen printing, the apparatus being configured to be arranged in a production line downstream of a machine for producing the objects (12), the apparatus comprising:

at least two printing stations (30), each printing station (30) comprising:

a printing screen (34) having a stencil (38) corresponding to a print to be produced;

at least one squeegee (46) which is moveable during a printing operation synchronously with the respective object to be decorated in the at least two printing stations, each object having a print region which is configured to receive a print image and which extends around a periphery of the object, the print image being comprised of at least two partial print images, the print region being comprised of a first portion which extends around a portion of the periphery of the object and a second portion which extends around another portion of the periphery of the object, the first and second portions being displaced relative to each other in a peripheral direction of the objects; and holders (24, 26) which respectively carry the objects rotatably about their longitudinal axes (50), the holders being mounted to a transport element (22) which transports the objects (12) continuously through the at least two printing stations (30) in which printing is effected during a transport by rolling the objects against the printing screen (34), the speed of the transport element (22) being predetermined by an output of the machine for producing the objects (12);

wherein the holders (24, 26) for carrying the objects (12) are arranged at a spacing (44) from each other in a transport direction (28), the spacing being smaller than a spacing that would be required for peripheral printing around 360° on the object in one working operation, and wherein at least one of the at least two printing stations (30) is associated with each of the portions of the print region, to apply one of the at least two partial print images to the associated portion, such that the at least two partial print images together form the print image.

* * * * *